United States Patent [19]

Ahroni

[11] Patent Number: 4,720,773

[45] Date of Patent: Jan. 19, 1988

[54] DECORATIVE LIGHT ASSEMBLY

[76] Inventor: Joseph M. Ahroni, 2701 W. Manor Pl., #204, Seattle, Wash. 98199

[21] Appl. No.: 865,796

[22] Filed: May 27, 1986

[51] Int. Cl.[4] ..... F21V 21/00

[52] U.S. Cl. ..... 362/249; 362/123; 362/806; 362/808

[58] Field of Search ..... 362/249, 806, 252, 253, 362/123, 808

[56] References Cited

U.S. PATENT DOCUMENTS

| | | | |
|---|---|---|---|
| 563,922 | 7/1896 | Gridley | 362/249 |
| 1,134,834 | 4/1915 | Fisher | 362/808 |
| 1,843,389 | 2/1932 | Fischer | 362/249 |
| 2,230,900 | 2/1941 | Neitzka | 362/806 |
| 2,453,695 | 11/1948 | Belling | 362/806 |
| 3,009,052 | 11/1961 | Holbrook | 362/806 |
| 3,036,206 | 5/1962 | Holbrook | 362/806 |
| 3,096,943 | 7/1963 | Ferrer | 362/806 |
| 3,204,366 | 11/1972 | Korb et al. | 362/249 |
| 3,681,589 | 8/1972 | Robarts | 362/252 |
| 3,723,723 | 3/1973 | Lerner | 362/806 |
| 4,404,621 | 9/1983 | Mauro | 363/806 |
| 4,415,953 | 11/1983 | Shepherd | 362/249 |
| 4,620,270 | 10/1986 | Laakso | 362/123 |

*Primary Examiner*—Raymond A. Nelli

*Attorney, Agent, or Firm*—Seed and Berry

[57] ABSTRACT

A decorative light assembly for Christmas trees wherein a collar adapted to be mounted at the top of the tree is formed with tabs over which the cord of a light string is hooked so that the string drapes from the collar in loops.

11 Claims, 5 Drawing Figures

DECORATIVE LIGHT ASSEMBLY

1. Technical Field

The present invention relates to display light sets for decorating Christmas trees or the like and means to assist evenly dispersing the lights.

2. Background Art

In decorating Christmas trees, it is difficult to arrange the lights in a relatively evenly dispersed manner on and between the tree limbs, even if all of the lights are in one continuous string, as is possible in three-wire systems such as those in which groups of series-connected low-voltage lights are connected in parallel, as disclosed in my co-pending application, Ser. No. 664,153, filed Oct. 24, 1984, or in two-wire systems using a transformer for reduction from the line voltage or using 110–120 volt bulbs.

DISCLOSURE OF THE INVENTION

The aim of the present invention is to provide a light mounting system of simple and economical construction whereby a string of lights can be more easily arranged on a Christmas tree or the like.

In carrying out the present invention, a mounting collar is provided to surround the tree trunk near the top of the tree. This collar presents a circumferential row of mounting tabs over which the wires of the light string can be hooked at regular intervals to divide the light string into a series of depending loops. The lights in each loop can be evenly spaced apart, or varied in a pattern, or the spacing between the lights at the bottom of the loops can be increased to divide each loop into two lighted end sections draping downwardly from the mounting collar in diverging relation and an intermediate unlighted section located adjacent the bottom of the tree. The mounting collar can be provided as part of an ornament at the top of the tree.

BEST MODE FOR CARRYING OUT THE INVENTION

Figure 1:
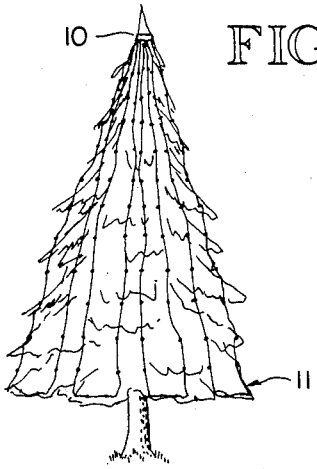
FIG. 1 is a perspective view illustrating a display light set (collar element and light string) according to the present invention applied to a Christmas tree.

Referring to the drawings, it is seen that a mounting collar 10 is provided for use with a light string 11. The collar 10 is preferably frustoconical in shape and formed from a strip (FIG. 3) having connecting means at its ends, such as, for example, a transverse slot 12 adjacent one end and a mating hook-type connector tab 14 at the other end which interfit to form a ring. A circumferential series of cutouts 16 is made in the collar 10 to provide a circumferential row of upstanding mounting tabs 18 which preferably have a dovetail shape formed by upwardly diverging side edges **18*a*–18*b* and a top edge 18*c*. Each cutout 16 preferably has sloping bottom edges 16*a*, 16*b* opposite the side edges 18*a*, 18*b* of the tabs 18**.

The light string 11 may be a single uninterrupted string of lights or may be formed by a series of light sets connected end-for-end into a continuous string. The bulbs **11*a* in the string may be of the plug-in or screw-in type mounted in sockets 11*b* and preferably are "miniature style," low-voltage lights which have a combined wattage less than 120 watts. The wires electrically connecting the light sockets 11*b* may be independent insulated conductors or encased as a single cord 11*c***. A suitable light string is disclosed in my co-pending application Ser. No. 664,153, filed Oct. 24, 1984, which is a three-wire set in which the wires (conductors) are in a single cord and connect the lights in a series-parallel arrangement, i.e., groups of lights in series are connected in parallel. Another suitable string is one or more of the type having, for example, 100 lights per set connected in a series-parallel arrangement with three insulated conductors twisted together and having an attachment plug at one end and an end connector at the other end so that two or more of the sets can be connected end-for-end. In such a string, normally one of the three conductors deadends within the attachment plug and another one of them deadends within the end connector. Long, two-wire light sets are also suitable for the practice of this invention if the bulbs have a 110–120 volt rating or a transformer is utilized in conjunction with the power supply to the set.

In view of the foregoing, for purposes of this description and accompanying claims, the word "string" includes two or more sets connected end-for-end, as well as a single set, and the word "cord" means insulated wires which may be twisted together, as well as meaning more than one conductor encased in a single insulating shield.

Figure 3:
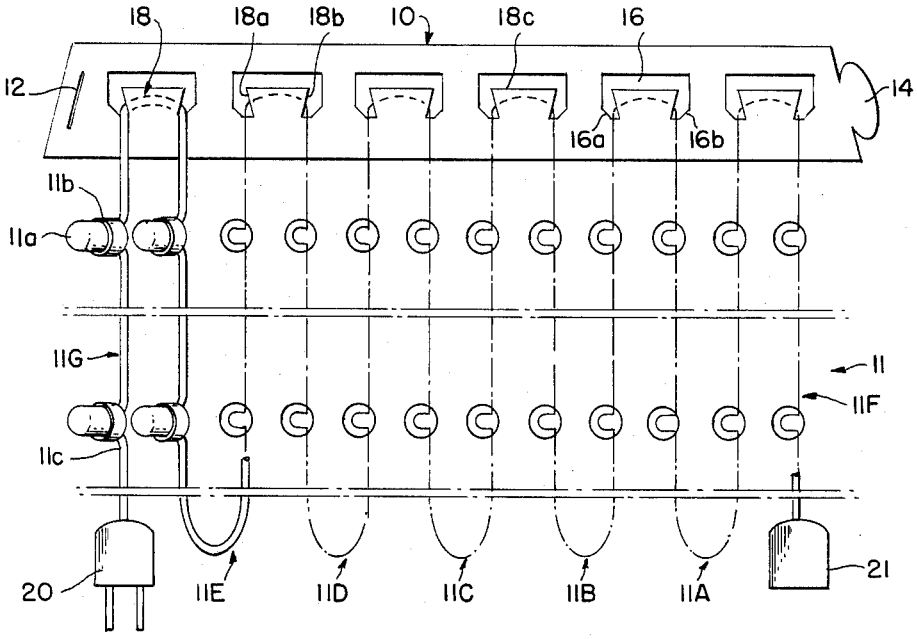
FIG. 3 is a plan view showing a light string connected to the collar element.
Figure 4:
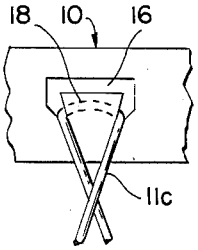
FIG. 4 is a detail view showing an alternative arrangement of the cord connection with the collar element.

As shown in FIG. 3, for initial packaging and storage between uses, and to prevent tangling, a light string 11 may be laid flat in a sinusoidal pattern in conjunction with the collar 10 while the collar is still in its flat strip configuration. The cord **11*c* of the string is hooked over the tabs 18 at regular intervals and wedged between the downwardly converging edges 18*a*–18*b* of the tabs and the opposing lower edges 16*a*–16*b*, respectively, of the cutouts 16. The cord can then be draped in loops, as indicated in FIG. 3. If desired, the cord 11*c* may be crossed at each tab 18, as indicated in FIG. 4**.

When the light string 11 is to be used, the collar strip may be closed into a ring by fitting the tab 14 into the slot 12. This may be done before application of the collar to the tree to be decorated, whereupon the collar (in ring form) is placed over the top of the tree, or can be done after the collar strip has been looped around the tree trunk at the desired location. In either instance, the collar 10 can be mounted on the tree with the light string 11 attached thereto, or the string can be applied to the collar after mounting of the collar on the tree.

For appearance reasons, it is preferred to have the light string 11 drape from the inside of the collar 10. In other words, when viewed as in FIG. 3, the collar strip would be closed into a ring by looping the collar strip toward the viewer.

Figure 2:
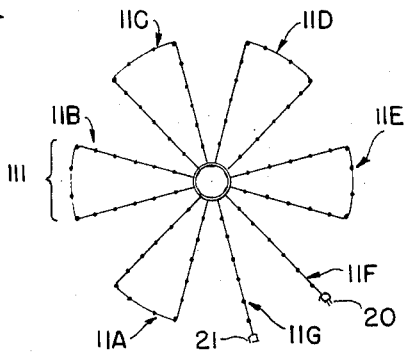
FIG. 2 is a top schematic view showing the light set as arranged on the tree.

For purposes of example, the collar 10 has been shown formed with six tabs 18. When the collar 10 and associated light string 11 have been placed on the tree, the five draping loop sections 11A–E of the string between tabs 18 can be conveniently arranged, as shown generally in FIGS. 1 and 2, and the two end segments 11F and 11G to the plug 20 and end connector 21 (if provided) can also be draped, as indicated in FIG. 2, to jointly provide a sixth section complementing loop sections 11A–11E.

It will be appreciated that the sections of cord 11*c* between tabs 18 may be draped on the tree in a zig-zag path down the tree, or in any other suitable manner, and that the bottom segment of each loop (marked 111 in FIG. 2 for loop section 11B), for example, may be veed upwardly or downwardly on the tree. In this regard, the light string may be manufactured with groups of regularly spaced sockets which are separated by unsocketed cord segments longer than the regular spacing between the sockets. These unsocketed cord segments then become the bottom segments 111 of the draped loops 11A–11E. As a further alternative, the bottom segments 111 can be provided, for example, with one or two sockets spaced at different intervals. It will also be understood that instead of having the string 11 hooked over the tabs 18 so that the upper sockets in the loop sections are equidistant from the respective tabs, as shown in FIG. 3, the string can be arranged relative to the tabs so that the sockets 11*b* at the end of each loop section are at different spacings from the supporting tabs.

Figure 5:
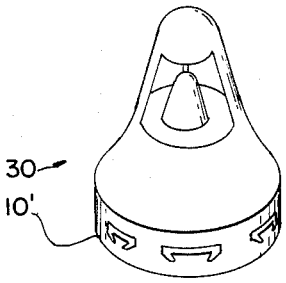
FIG. 5 is an elevational view of a top ornament embodying the collar element.

As shown in FIG. 5, the collar 10 can be incorporated as a skirt section 10′ in a conical top ornament 30 for the tree. Hence, the word "collar," as used in the annexed claims, is intended to include a circular part of a head segment or the like.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A decorative light assembly comprising:

a long string of lights having a cord extending between light sockets containing bulbs and a plug at an end of said string;

a collar adapted to surround the trunk of a Christmas tree near the top of the tree and having a circumferential row of mounting devices; and said cord engaging said mounting devices at spaced intervals and arranged such that said string of lights has multiple loops draping from said collar between the mounting devices.

2. A decorative light assembly according to claim 1 in which said mounting devices comprise mounting tabs integral with said collar and said cord is passed around said tabs.

3. A decorative light assembly according to claim 1 in which said mounting devices comprise upstanding mounting tabs formed by cutouts in the collar, and said string of lights is hooked over said tabs.

4. A decorative light assembly according to claim 3 in which said tabs are dovetailed in shape and each has two side edges which converge with bottom edges of the respective cutout located on both sides of the root end of the tab.

5. A decorative light assembly according to claim 1 in which an end portion of said string of lights having said plug drapes from one of said mounting devices, and an end portion of said string at the opposite end of the string drapes from an adjoining mounting device.

6. A decorative light assembly according to claim 1 in which said collar comprises a flexible strap having mating fastening means at its ends whereby the strap can be looped into a ring and fastened at its ends.

7. A decorative light assembly according to claim 1 in which said string of lights has three wires and said light sockets are divided into groups of series-connected sockets, with said groups wired in parallel.

8. A decorative light assembly according to claim 1 in which said collar is part of a generally conical ornament for mounting at the top of a tree.

9. A decorative light assembly according to claim 1 in which the spacing of said light sockets in a bottom segment of each loop is greater than the spacing between most of the remaining light sockets.

10. A device for mounting a string of lights comprising a strip having integral complementing fastening means at its ends for forming a collar from the strip, and having a row of cutouts forming a row of mounting tabs adapted to have the cord of a light string hung thereover to divide the string into loops.

11. A device according to claim 10 in which said tabs are dovetailed in shape.

* * * * *